US005415742A

United States Patent [19]

La Camera et al.

[11] Patent Number: 5,415,742

[45] Date of Patent: May 16, 1995

[54] PROCESS AND APPARATUS FOR LOW TEMPERATURE ELECTROLYSIS OF OXIDES

[75] Inventors: Alfred F. La Camera, Trafford; Kathleen M. Tomaswick, Natrona Heights; Siba P. Ray, Murrysville; Donald P. Ziegler, New Kensington, all of Pa.

[73] Assignee: Aluminum Company of America, Pittsburgh, Pa.

[21] Appl. No.: 137,432

[22] Filed: Oct. 15, 1993

Related U.S. Application Data

[62] Division of Ser. No. 761,414, Sep. 17, 1991, Pat. No. 5,279,715.

[51] Int. Cl.[6] ..... C25B 9/00; C25B 15/02; C25C 3/20

[52] U.S. Cl. ..... 204/1.11; 204/67; 204/68; 204/244; 204/245; 204/291

[58] Field of Search ..... 204/243 R–247, 204/67, 267–270, 1.11

[56] References Cited

U.S. PATENT DOCUMENTS

| | | | |
|---|---|---|---|
| 3,700,581 | 10/1972 | Devarda | 204/244 X |
| 3,718,550 | 2/1973 | Klein | 204/67 |
| 3,852,173 | 12/1974 | Jacobs et al. | 204/67 |
| 3,951,763 | 4/1976 | Sleppy et al. | 204/67 |
| 3,960,678 | 6/1976 | Alder | 204/67 |
| 3,996,117 | 12/1976 | Graham et al. | 204/67 |
| 4,039,419 | 8/1977 | Buse | 204/225 |
| 4,045,309 | 8/1977 | Andersen | 204/67 |
| 4,098,669 | 7/1978 | De Nora et al. | 204/252 |
| 4,210,513 | 7/1980 | Mutschler et al. | 204/225 |
| 4,233,148 | 11/1980 | Ramsey et al. | 204/291 |
| 4,269,673 | 5/1981 | Clark | 204/67 |
| 4,333,803 | 6/1982 | Seger et al. | 204/67 |
| 4,374,050 | 2/1983 | Ray | 252/519 |
| 4,392,925 | 7/1983 | Alder | 204/245 X |
| 4,454,015 | 6/1984 | Ray et al. | 204/293 |
| 4,455,211 | 6/1984 | Ray et al. | 204/293 |
| 4,478,693 | 10/1984 | Ray | 204/64 R |
| 4,500,406 | 2/1985 | Weyand et al. | 204/293 |
| 4,592,812 | 6/1986 | Beck et al. | 204/67 |
| 4,620,905 | 11/1986 | Tarcy et al. | 204/64 R |
| 4,681,671 | 7/1987 | Duruz | 204/67 |
| 4,770,755 | 9/1988 | Yalanti et al. | 204/269 X |
| 4,786,379 | 11/1988 | Barnett | 204/245 X |
| 4,865,701 | 9/1989 | Beck | 204/244 X |
| 4,871,437 | 10/1989 | Marschman et al. | 204/291 |
| 4,960,494 | 10/1990 | Nguyen et al. | 204/67 |
| 5,006,209 | 4/1991 | Beck et al. | 204/67 |
| 5,015,343 | 5/1991 | LaCamera et al. | 204/67 |

FOREIGN PATENT DOCUMENTS

| | | |
|---|---|---|
| 1461155 | 1/1977 | United Kingdom . |
| W089062 | 7/1989 | WIPO . |
| WO890629 | 7/1989 | WIPO . |

*Primary Examiner*—Donald R. Valentine
*Attorney, Agent, or Firm*—Richard V. Westerhoff; Jolene W. Appleman; Glenn E. Klepac

[57] ABSTRACT

A process for electrowinning metal in a low temperature melt is disclosed. The process utilizes an inert anode for the production of metal such as aluminum using low surface area anodes at high current densities.

20 Claims, 8 Drawing Sheets

$Na_3AlF_6 - AlF_3$ PHASE DIAGRAM

PROCESS AND APPARATUS FOR LOW TEMPERATURE ELECTROLYSIS OF OXIDES

This is a division of application Ser. No. 07/761,434, filed Sep. 17, 1991, now U.S. Pat. No. 5,279,715.

FIELD OF THE INVENTION

The present invention relates to the low temperature electrolysis of oxides, specifically the production of aluminum from alumina dissolved in low melting temperature salt baths.

BACKGROUND OF THE INVENTION

The Hall-Heroult process was first used commercially around 1900. In this process, aluminum is extracted by electrolyzing aluminum oxide (also known as "alumina") dissolved in a molten salt bath based on cryolite, $Na_3AlF_6$. The molten cryolite is operated at a temperature generally with the range of 950°–1000° C. In the electrolytic cell, a carbon lining within a crucible typically serves as the cathode, and the anodes, typically carbon, are immersed in the molten salt. The molten cryolite-aluminum oxide serves as the electrolyte solution. Heat produced, for example, by a large electric current in the cell, melts the cryolite which dissolves the aluminum oxide and maintains the aluminum being electrolyzed in the molten state in which it collects in the bottom of the cell.

The Hall process, although commercial today, has certain limitations, such as the requirement that the process operate at relatively high temperatures, typically around 970° C.

The high cell temperatures are necessary to achieve a high alumina solubility. At these temperatures, the electrolyte and molten aluminum progressively react with most carbon or ceramic materials, creating problems of metal and electrolyte containment and cell design.

The high temperature salt baths of the prior art are typically enveloped in a frozen sidewall and/or frozen ledge of salt bath, which helps reduce the corrosive effects of the electrolyte and metal on the containment vessel. Maintaining a frozen sidewall or ledge, however, requires a significant heat loss from the system, and any attempt to insulate the system to significantly conserve heat loss results in the melting of the frozen ledge or sidewall.

In general, the carbon anodes are consumed in the Hall process with the evolution of carbon oxide. Practically speaking, the consumption of carbon anodes requires adjustment of the anode-cathode distance to maintain it within certain critical limits. Although 0.33 kg of carbon is theoretically required for each kilogram of aluminum produced, nearly 0.5 kilograms of carbon per kilogram of aluminum can actually be consumed, for instance by losses due to air burning and back reaction between aluminum and $CO_2$. Purity requirements for the aluminum produced necessitate the use of high quality coke for the anodes. In the United States alone, carbon consumption for the production of aluminum is nearly 2–5 million tons per year. If an inert anode could be found to replace the carbon anodes the energy content of the coke could be saved, and $O_2$, rather than carbon oxide would be produced at the anode. In addition, emissions of fluorocarbons and sulfur would be eliminated.

Other disadvantages of the Hall cell include sodium intercalation and formation of sodium aluminum oxide which causes heaving and cracking of the cell lining, with resulting interference in operating characteristics of the cell and shortened cell life, requiring periodic cell relining.

Numerous methods have been attempted to overcome some or all of the above shortcomings of the Hall process. While many of these methods have met with some success, none has replaced the conventional Hall process in commercial applications. One attempt has been to utilize so-called "low temperature" salt baths which allow reduced energy consumption at the expense of lower alumina solubility. For example, U.S. Pat. No. 3,951,763 discloses a low temperature salt bath and uses a carbon anode, which is consumed in the process. U.S. Pat. No. 3,996,117 adds 5% to 10% by weight LiF to the bath.

One of the drawbacks of the low temperature salt bath technology has been the realization that reduction of salt bath temperature likewise leads to reduction of alumina solubility. Attempts to overcome this problem include those disclosed in U.S. Pat. No. 3,852,173 wherein the alumina is provided with a sufficient water content to prevent anode dusting, which water content also assists in dispersing the alumina into the low temperature salt bath solution of $NaF/AlF_3$. However, providing the water-containing alumina is an added requirement of the process and naturally incurs added expense.

Attempts at operating the salt bath at lower temperatures by using progressively lower bath weight ratios than the 1.1:1 NaF to $AlF_3$ bath ratios typically used have been frustrated by the formation of a crust of frozen electrolyte over the molten aluminum as electrolysis proceeds. This crust drastically increases resistance at the cathode, reduces metal coalescence and causes deposition of sodium, which in turn, hampers current efficiency. Under these conditions, the cell can no longer be operated efficiently.

Various attempts have been made to utilize so-called "inert" anodes in order to improve the Hall process. See, e.g., U.S. Pat. Nos. 3,718,550; 3,960,678; 4,098,669; 4,233,148; 4,454,015; 4,478,693; 4,620,905, 4,620,915 and 4,500,406. Attempts have also been made to use inert anodes with low temperature salt baths. U.S. Pat. No. 4,455,211 discloses a low temperature salt bath of $NaF/AlF_3$ which teaches the addition of 1% to 15% LiF and an inert anode made of an interwoven matrix. PCT Application No. WO 89/06289 discloses the use of an inert anode in connection with a metal chloride and/or metal fluoride salt bath using additives for low temperature aluminum electrolysis. However, this reference teaches the need to increase the actual anode surface area by 2 to 15 times the superficial or projected anode surface area. Such increased surface area anodes are typically fabricated, for example, by drilling numerous holes deep into the anode or using an array of plates or rods for anodes. Such anodes typically have an active surface area several times the cathode active surface area.

U.S. Pat. No. 4,681,671 discloses a low temperature salt bath which is used in conjunction with an anode having a relatively large surface area (actual or active area at least 1.5 times larger than the projected surface area) and low current density. Indeed, this reference teaches the necessity of utilizing a low current density and increased anode surface area in conjunction with low temperature salt baths and inert anodes.

OBJECTS OF THE INVENTION

Accordingly, it is an object of the invention to provide a process for the production of metals, particularly aluminum, by the electrolysis of the corresponding metal oxides dissolved in a molten electrolyte at low temperatures using an inert anode without the need to increase the active surface area of the anode beyond the projected surface area of the anode, and having an active anode surface area about equal to the active cathode surface area.

It is another object of the invention to provide a process for the production of metal by the electrolysis of metal oxides, such as alumina, which can be performed by retrofitting existing metal-producing, e.g., aluminum-producing, electrolyte-containing cells.

It is another object of the invention to provide a novel low temperature salt bath/inert anode combination, which combination is especially effective for the production of aluminum by the electrolysis of $Al_2O_3$.

It is yet another object of the invention to provide a low temperature salt bath system which may be operated substantially without a frozen sidewall or ledge of salt.

It is still a further objective of the invention to provide an anode/cathode system which may be used to control the power applied to the system by changing the anode-cathode area.

SUMMARY OF THE INVENTION

We have surprisingly found a low temperature salt bath composition/inert anode combination, which may be used at high or low anode current densities and in connection with low anode surface area for the production of metals by electrolysis. The anode has an active or wetted surface area of about 0.7 to 1.3 times the active surface area of the cathode and more preferably is about equal to the cathode active surface area. The preferred method employs an inert anode and a eutectic salt bath, preferably comprised of NaF and $AlF_3$ operating in the range of 0.1 to 1.50 $A/cm^2$ using a planar anode.

In another preferred embodiment of the invention, the temperature of the salt bath is maintained at 685°-900° C., and this salt bath comprises 36 wt. % NaF and 64 wt. % $AlF_3$. In yet another preferred embodiment of the invention, the inert anode comprises a copper-cermet anode.

In a most preferred embodiment of the invention, the inert anode comprises about 17% by weight copper and 83% by weight oxides, the oxides comprising about 52% by weight NiO and about 48% by weight $Fe_2O_3$.

Surprisingly, we have found that when the invention is utilized in a cell, electrowinning of metal is possible at high current densities and on low surface area anodes, producing oxygen at the anode with low fluoride emission and leaving the anode substantially free of corrosion even after periods of electrolysis.

BRIEF DESCRIPTION OF THE DRAWINGS

A full understanding of the invention can be appreciated from the following Detailed Description of the Invention when read with reference to the accompanying drawings wherein:

FIGS. 3*f*–3*l* are SEM micrographs and x-ray images of an unexposed inert anode of the type used in FIGS. 3*c*.

Figure 3A:
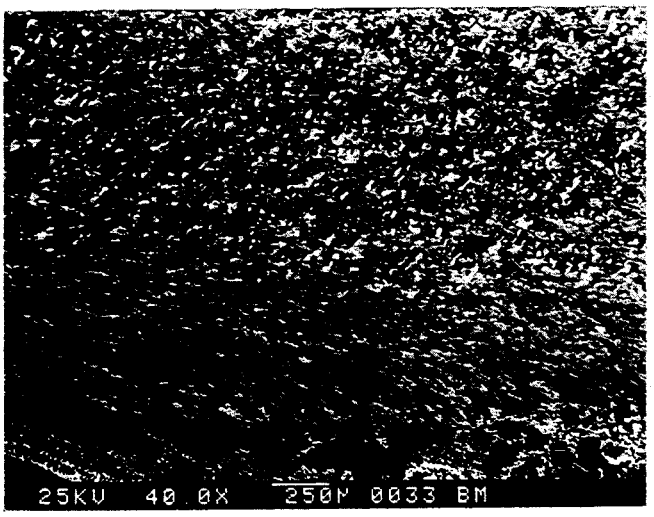
FIG. 3*a* is an SEM micrograph of an inert anode after electrolysis in a 49 wt. % NaF/43.6 wt. % $AlF_3$ and 14.5 wt. % LiF electrolyte.

The horizontal white line at the bottom of FIGS. 3*a*, 3*c*–3*l* shows the scale of the respective Figure. For example, the length of the line in FIG. 3*a* is 250 microns.

Figure 4:
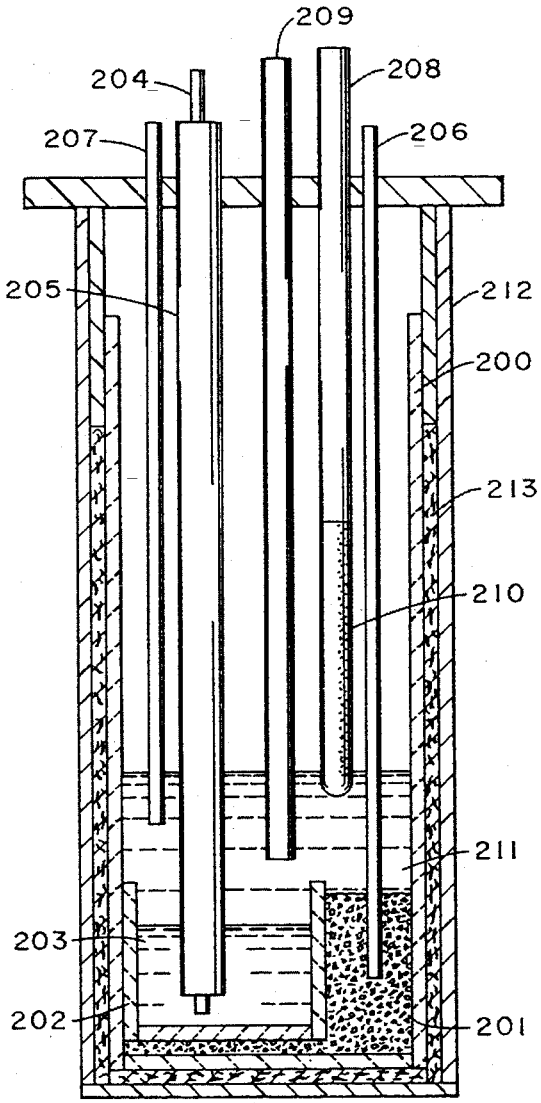

FIG. 4 is a schematic representation of a bench scale cell, in partial cross section, useful in practicing the method of the present invention.

Figure 5:
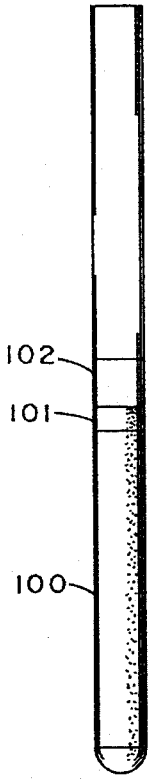

FIG. 5 is a schematic representation of an inert anode useful in practicing the present invention.

Figure 6:
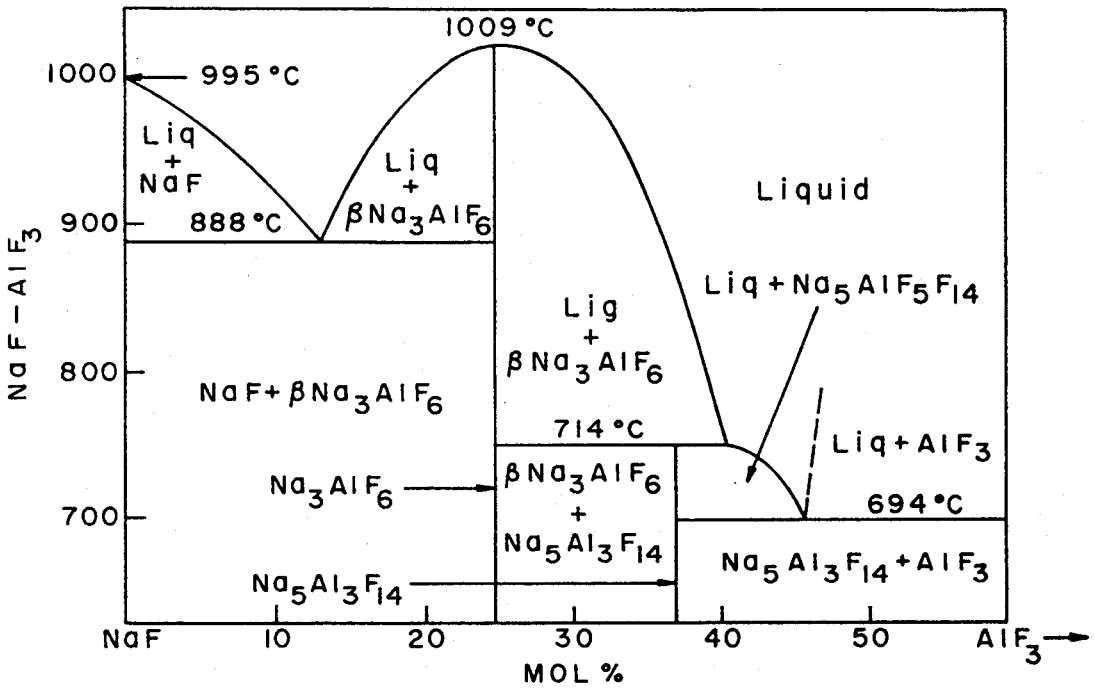
Figure 8:
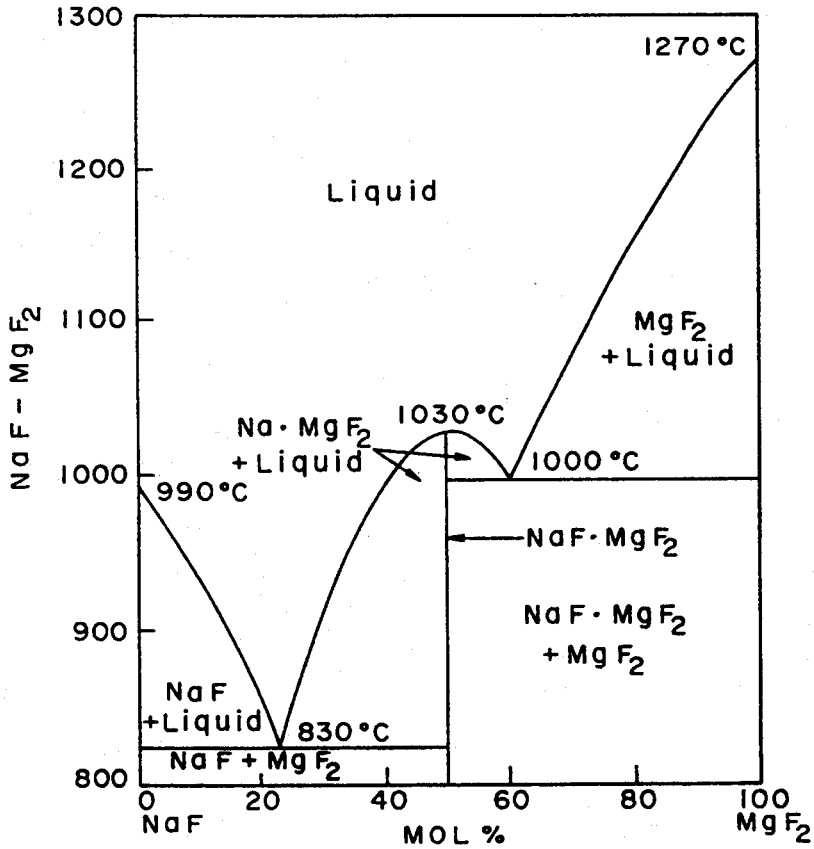
Figure 7:
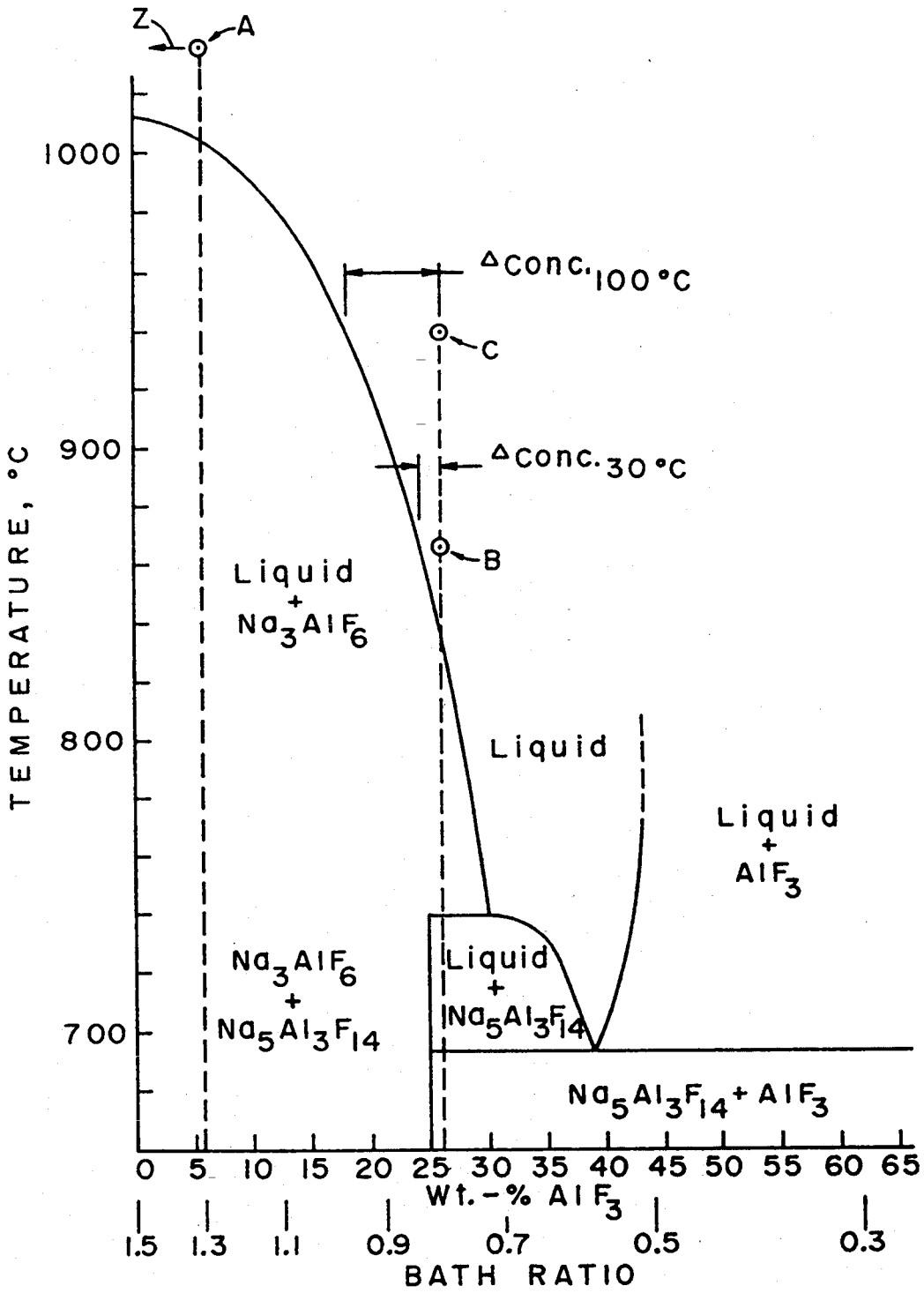

FIGS. 6–8 are phase diagrams for various salt baths useful in practicing the present invention.

DETAILED DESCRIPTION OF THE INVENTION

Figure 1:
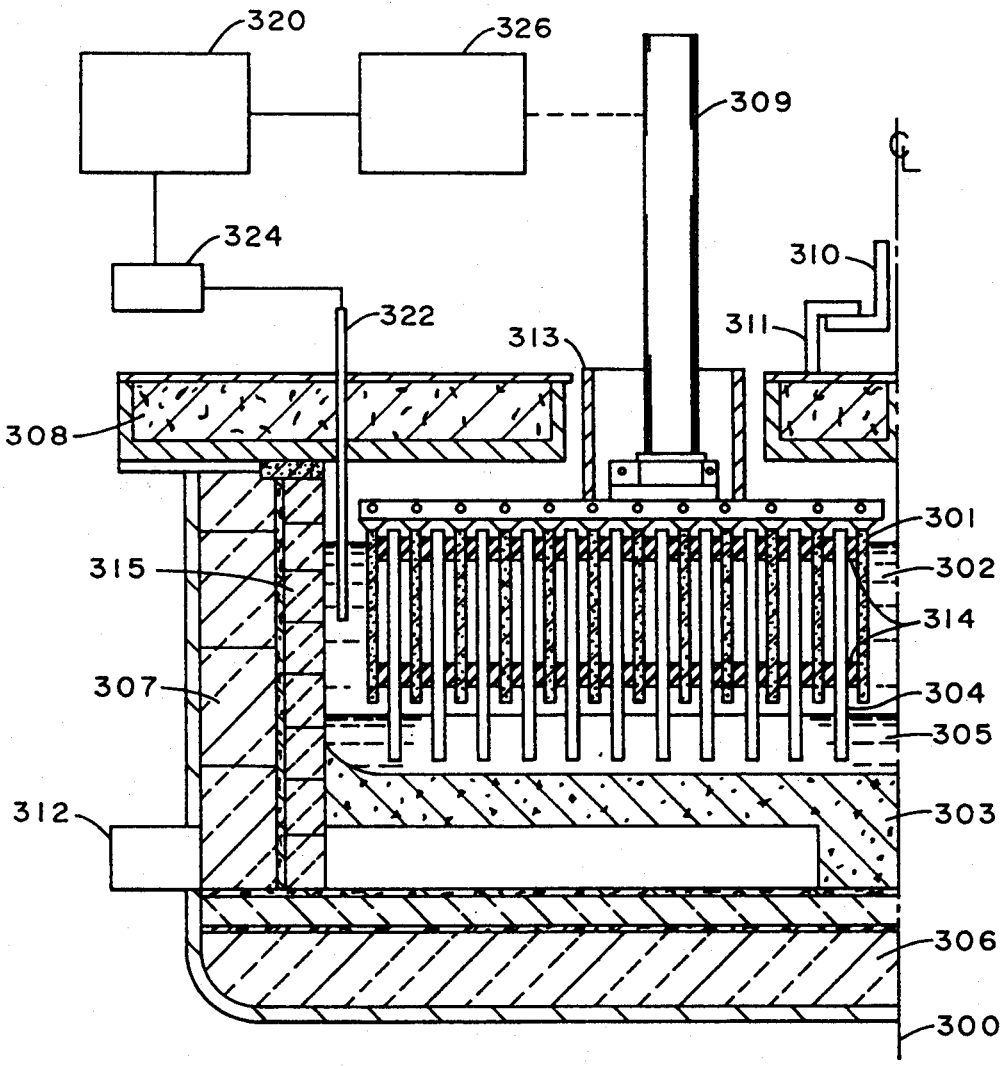
FIG. 1 is a schematic representation of half of an oxide electrolysis production cell, left of the centerline, in partial cross-section, which may be used in practicing the present invention, including interleaved anodes and cathodes which may be raised or lowered as a unit.

An embodiment of the invention is illustrated in FIG. 1 and la which shows the half of a production cell left of the centerline 300, where the inert anodes 301 and the cathodes 304 are in an interleaved vertical planar array. As shown, 301 comprises inert anodes of the present invention, 302 is the electrolyte, a low temperature molten salt bath according to the present invention, the compositions of which are described subsequently, and 303 is a carbonaceous, electrically conductive floor.

Figure 1A:
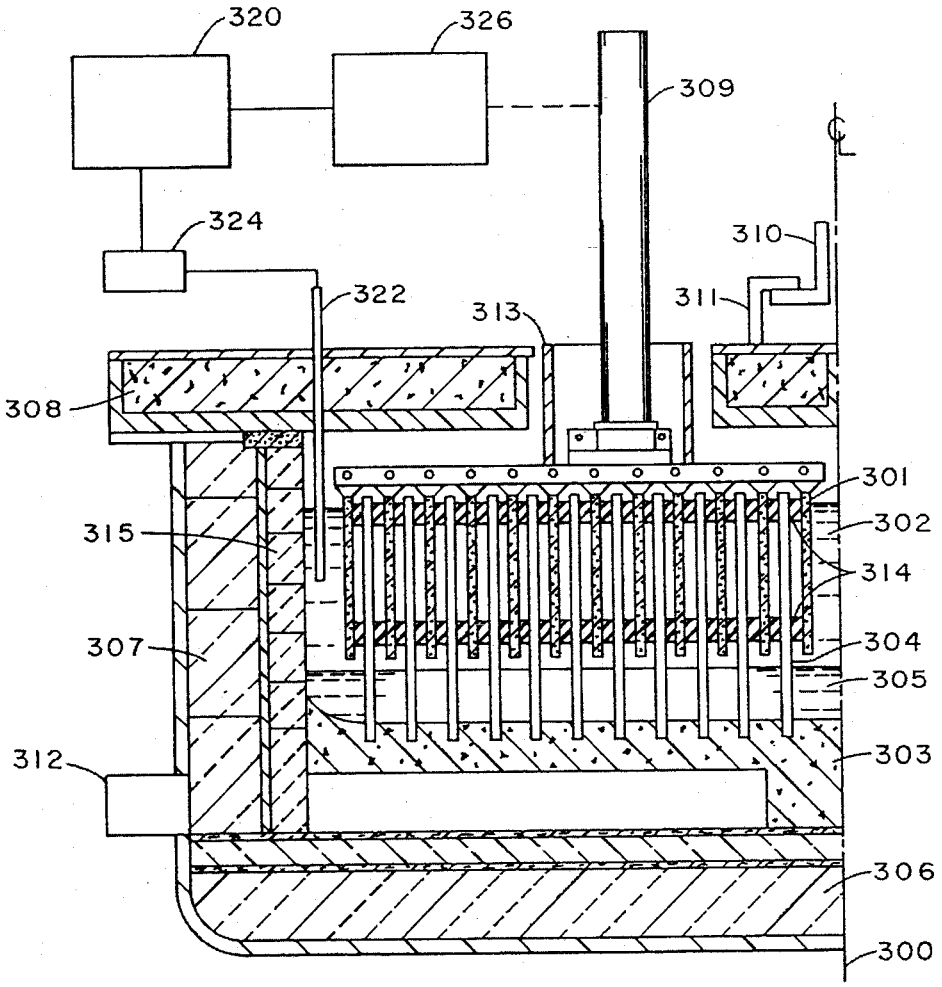
FIG. 1*a* is a schematic representation of half of an oxide electrolysis production cell, left of the centerline, in partial cross section, which may be used in practicing the present invention, including interleaved anodes and cathodes wherein the cathodes are embedded in the cell floor and the anodes may be raised or lowered relative to the cathodes.

A molten metal (e.g. aluminum) cathode pad 305 receives the cathodes 304 and rests on the floor 303. As illustrated in FIG. 1*a* the cathodes 304 may be supported in the cell by any suitable means, such as by securing the cathodes 304 in or to the cell floor 303. FIG. 1 shows the cathodes suspended from the anode assembly and spaced from the anodes with suitable electrical insulators, 314.

Thermal insulation is provided by a bottom lining 306, a sidewall 307 and a lid 308. The lid is sufficiently insulating for operation without a frozen crust. Also, sidewall insulation is sufficient for operation without a frozen sidewall.

A rod, generally 309, functions as an anode collector bar for providing d.c. electrical current to the anodes 301. The cell lid 308 is attached to a superstructure, generally 310, via an elbow 311, and rests on the sidewall 307. Current is removed from the cell through a cathode collector bar 312. A sleeve 313 protects the connection between the anode collector bar 309 and the anodes 301 from molten salt. A larger anode can be employed, because there is no frozen electrolyte to interfere with its positioning. The active area or wetted area of the anodes 301 and cathodes 304 is approximately the same.

The anode-cathode space is the distance between the vertical anode and cathode in the FIG. 1 and 1a embodiments. As illustrated in FIG. 1, this space, with respect to the vertical cathodes 304, is maintained by spacers 314, which are preferably fabricated of an electrically insulating material. The spacers 314 may be adapted to bond to either the anode or the cathode, and to slide relative to the electrode to which they are adjacent but not bound.

The current flow is from the anode collector bar 309 into a metal distributor to the vertical anodes 301, down the anodes, through their projected or wetted area through the anode-cathode space to the cathodes 304, down the cathode plates into the metal pad 305, which also serves as a cathode, then into a standard carbon electrode and cathode collector bar. Current densities from 0.1 to 1.50A/cm$^2$ can be achieved depending on the number of anode and cathode plates used in the assembly and the position of the anode assembly relative to the electrolyte level, as discussed hereafter.

The anodes 301 preferably have a combined active surface area about 0.7–1.3 times the active surface area of the cathodes. In a highly preferred embodiment, the wetted anode surface area is about equal to the active cathode surface area.

The power to the cell is controlled by moving the anode assembly up or down, and/or raising or lowering the melt level, which changes the resistance in the anode-cathode spacing and, therefore, the voltage drop in the cell, particularly in the case of constant current operation, which is industrial standard practice. Cell power is the product of the cell current and voltage. As illustrated, a space is provided below the lid to accommodate the movement of the anode assembly of anodes 301 and rod 309.

Figure 2:
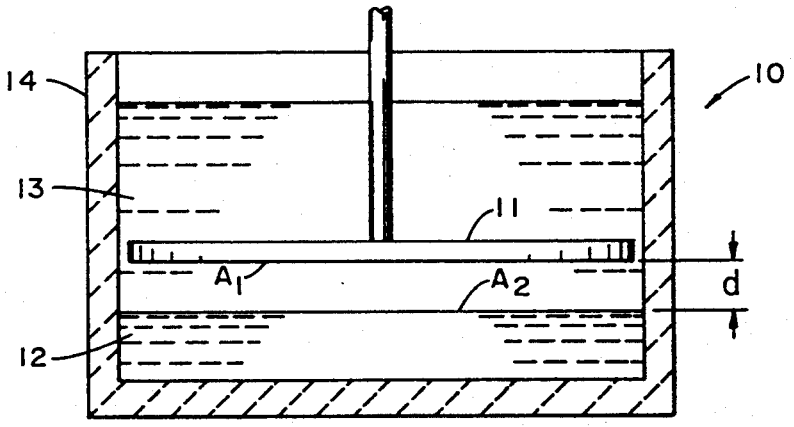
FIG. 2 is a schematic representation in partial cross-section of a cell which may be used in practicing the present invention.

It is well known to control the amount of heat being input to a cell such as disclosed in FIG. 2 by raising or lowering the anode to vary distance d, and thus the length of the resistance path through the molten salt bath 13, in order to vary the $I^2R$ heating.

In contrast, it is not readily apparent in the case of the cell of FIGS. 1 or 1*a* how heat might be controlled, since the anode-cathode spacing, d, is fixed. According to the invention, it has been realized that heat control may nevertheless be achieved in the case of the cell of FIG. 1 and FIG. 1*a* using an anode-cathode assembly and/or melt level raising and lowering technique. In the FIG. 1 embodiment, the spacers 314 join the anodes 301 and cathodes 304 in a fixed assembly, such that the anodes and cathodes do not move relative to one another but may be raised or lowered as a group. In the FIG. 1*a* embodiment, the cathodes 304 are embedded in the floor 303 and the anodes 304 may be raised or lowered relative to the fixed cathodes, the spacers 314 in this context being adapted for such slidable engagement. Thus, while the distance between the electrodes in FIGS. 1 and 1*a* does not change with a raising or lowering of the electrodes, the effective area of the resistive volume of molten salt does change at a constant electrolyte level. The resistance between each neighboring anode-cathode pair is $$R=\rho(d/A) \tag{1}$$

where: R=resistance, d=anode-to-cathode spacing, A=effective area of the resistive volume of molten salt, and $\rho$=resistivity of the molten salt. While d remains constant, A does vary with the raising or lowering of the anode assembly relative to the electrolyte level (electrode immersion) and, therefore, heat input to the cell of FIG. 1 also varies with the degree of electrode immersion. This is true for an anode-cathode pair or for a group or assembly of anode-cathode pairs. The equivalent resistance for an anode-cathode assembly or groups of these assemblies is $$R_{eq}=R/n \tag{2}$$

given that the R for each anode-cathode pair is the same, assuming similar anode-cathode spacing and size of electrodes, where $R_{eq}$ is the equivalent resistance of the assembly or groups of assemblies and n is the number of pairs of anode-cathode spaces formed. This resistance in the anode-cathode spacing is proportional to the distance the anodes and/or cathodes are raised in FIG. 1, FIG. 1*a* and FIG. 2. However, the FIG. 1 and 1*a* embodiments offer a greater degree of control than the FIG. 2 embodiment. For example, a ¼" raising of the anode of FIG. 2 results in a 14% change in resistance, whereas a ¼" raising of the anodes and cathodes of FIG. 1 or the anodes of FIG. 1*a* result in only a 2.4% change in resistance, as will now be demonstrated.

The percent change in power to the FIG. 2 embodiment can be readily estimated from Equation 1 assuming an anode-to-cathode spacing of 1.75 inches.

Thus, $$\begin{aligned}\%\ \text{change} &= \frac{R_1 - R_2}{R_1} \\ &= \frac{d_1 - d_2}{d_1} \\ &= \frac{1.75 - 1.5}{1.75} = 14.3\%\end{aligned}$$

Equation 2 can be used to estimate the percent change power in the FIG. 1 and FIG. 1*a* embodiments for changes in anode-cathode assembly immersion. In Equation 3, R is replaced with Equation 1.

$$R_{eq} = \frac{\rho d}{An} \tag{3}$$

Equation 4 can be used to estimate of the percent change in power for a ¼ inch change in anode-cathode assembly immersion. The immersion depth of the anode-cathode assembly is assumed to be 10 inches. The percent change in resistance is independent of the anode width.

$$\%\ \text{Change}=(R_{eq1}-R_{eq2})/R_{eq1} \tag{4}$$

This can be reduced to a ratio of areas, $$\%\ \text{Change}=1-(A_1/A_2)$$

or indeed, a ratio of depth of the immersed vertical electrodes, $$\% \text{ Change} = 1 - (h_1/h_2)$$

Where $h_1$ is the initial depth of electrode immersion and $h_2$ is the depth of immersion after raising or lowering the electrodes.

For the embodiments of FIG. 1 or 1*a* a ¼ inch change in electrode immersion results in a 2.4% change in power to the cell.

$$\begin{aligned} \% \text{ change} &= 1 - \frac{10}{10.25} \\ &= 1 - .9756 \\ &= 2.4\% \end{aligned}$$

As is now apparent, it is possible to control the temperature of the electrolytic cell by varying the extent of cross-sectional area for current flow between the interleaved anodes and cathodes of FIG. 1 and FIG. 1*a*. This may be accomplished in a number of ways. One method is to provide the anodes and cathodes in a fixed assembly, as in FIG. 1, such that the anodes and cathodes are fixed relative to each other. This assembly is then adapted to be raised from or lowered into the bath. Alternatively or cumulatively, the bath level may be raised or lowered. The degree to which the vertical anodes and cathodes are immersed in the bath dictates the amount of area available for current flow between the anodes and cathodes. As the electrodes are raised, the immersed area decreases because of the electrode leaving the melt and also because of the melt level dropping as a result of lost electrode displacement. Thus, raising the electrode assembly from the bath decreases the area of electrodes wetted by the bath, lowers the bath level, and therefore on increases the $I^2R$ losses, and raises the bath temperature. Conversely, lowering the assembly into the bath increases the amount of electrode area available for current flow, increases the melt level and therefore decreases $I^2R$ losses and lowering the bath temperature.

In another embodiment of the invention, illustrated in FIG. 1*a*, the anodes and cathodes may be adapted to move relative to one another as previously described, and the cross sectional area for current flow between the interleaved anodes and cathodes is achieved by varying the extent of interleaving between the anodes and cathodes. In this case, removing, for example, at least some of the anodes at least partially from the bath has an effect similar to that previously described, as the amount of wetted anode area is reduced, depending on the number of anodes removed from the melt and the extent of removal.

Of course, it would also be possible to withdraw some or all of the cathodes from the melt to vary the amount of interleaving between the anodes and cathodes. If this is done, however, care must be taken not to withdraw the cathodes so far as to remove them from the molten cathode pad. Similarly, when the cathode pad is periodically tapped, care must be taken that the cathode pad level not drop below the cathodes. Particularly in the embodiment of FIG. 1, where the anodes and cathodes move up and down as one fixed unit, attention must be given to the relationship between the cathodes 304 and the molten metal pad 305. It is necessary to always maintain the cathodes in contact with the molten metal pad 305, in order that the cathode plates will maintain cathodic potential. This is a matter of engineering which requires the balancing of several different factors. During electrolysis, the depth of the metal pad increases, which pushes the electrolyte higher and requires a raising of the anode-cathode assembly, in order to keep a constant amount of electrolyte between the electrodes to maintain constant power input to the cell. As the pad depth grows, the cathode plates get farther and farther away from the floor of the cell, yet remain in contact with the metal pad. There comes a time when the pad depth has built sufficiently that the cell must be tapped, to remove metal product. This sinks the electrolyte and requires that the anode-cathode assembly be lowered, in order to keep a constant amount of electrolyte between the electrodes to maintain constant power input to the cell. But, of course, one cannot lower the assembly so much that the cathodes would jam into the floor of the cell. This places a constraint on how much metal can be tapped. And, a certain extra amount of metal must be left on the floor, in order that the anode-cathode assembly can be raised and lowered sufficiently to maintain control of the cell.

A portion of FIG. 1 and FIG. 1*a* illustrates heat control according to the invention. The control is based on a digital computer 320. The programming of the computer may be similar to that used for heat control of cells of the type illustrated in FIG. 2. A temperature sensor 322, for instance a thermocouple, supplies a temperature-indicative signal to a signal converter 324 interfaced with the computer 320. The computer 320 in turn controls an electrode, vertical position adjuster 326, which may be built as disclosed in any of the U.S. Pat. Nos. 4,039,419, 4,210,513, and 4,269,673, incorporated by reference herein. In the heat control package illustrated in FIG. 1, solid lines indicate electrical linkages, whereas the dashed line represents a mechanical linkage.

As also illustrated in FIGS. 1 and 1*a*, the use of the low temperature salt bath of the present invention avoids the need to form a frozen ledge and/or sidewall of salt around the bath. This, in turn, permits the use of an insulating lining, 315, between the bath 302 and the sidewall 307, and therefore results in substantial energy savings relative to high temperature salt bath systems.

Depending on the relative densities of the molten salt and molten metal, the positions of the anode and cathode may be reversed. The circulation pattern executed by the molten salt in the cell of FIGS. 1 and 1*a* will be influenced both by the gas-lift action of the evolved anode product and by electromagnetic phenomena, and the resulting circulation pattern executed by the molten salt will be the result of those combined effects.

Electromagnetic effects become more important in production cells because of their large size (e.g. 15-foot by 40-foot rectangular dimensions in the horizontal plane) and the larger electrical current passing through them (e.g. 125 to 150 kiloamperes). For further information on circulation patterns caused by electromagnetic effects, see Walter E. Wahnsiedler's "Hydrodynamic Modeling of Commercial Hall-Heroult Cells" appearing in "Light Metals 1987", pp 269+.

The salt bath circulation will act to keep undissolved alumina particles in suspension. Points of addition of replenishment alumina may be chosen based on the molten salt circulation pattern to effect an optimum, rapid incorporation of fed alumina into the molten salt.

FIG. 2 illustrates schematically another cell design 10 useful in practicing the invention. As illustrated, a single planar anode 11 is positioned above a molten aluminum cathode pad 12. A molten salt bath 13 is contained by a crucible 14. The anode 11 has an active or wetted surface area $A_1$, which is about 0.7–1.3 times the active surface area $A_2$ of the cathode. Most preferably, $A_1 = A_2$. The anode-cathode spacing is illustrated in FIG. 2 as d, and is the distance from the bottom of the planar anode 11 to the top surface of the cathode pad. As the anode 11 is drawn up, away from the cathode pad, d becomes larger, increasing the resistance to current flow between the electrodes and the power to the cell. This, in turn, increases the cell temperature. This practice is used commercially to control the power to the cell.

The inert anode used in practicing the invention differs from that of prior art anodes in that it has a relatively low surface area, the actual or active surface area preferably being only about one times the projected surface area of the anode. The anode is preferably made of a cermet material which is inert to the salt bath under operating conditions, most preferably a cermet containing about 12–25% by weight of a metal or metal alloy and the remaining 75–88% a ceramic or metal oxide phase. In a most preferred embodiment of the invention, the inert anode comprises, for example, by weight, 74–87% Cu-11–23% Ni 1.5–3.4% Fe; 60% Cu-40% Ni; 98% Cu-2% Ag; or 94% Cu-6% Sn alloys as the metal phase and a mixture of NiO and $Fe_2O_3$ as the oxide phase. The metal phase may also comprise 100% Cu.

In a highly preferred embodiment of the invention, the metal phase comprises copper and the oxide phase comprises a mixture of NiO and $Fe_2O_3$. In this embodiment, the copper phase comprises about 12–25% by weight of the anode composition and the balance comprises the oxide phase which consists of about 50–60 mole % NiO and about 40–50 mole % $Fe_2O_3$. While the particular compositions of inert anodes are provided herein for example only, it is contemplated to be within the scope of the present invention that other inert anodes (i.e., those liberating $O_2$ during or hereinafter developed could be used in practicing the present invention.

In general, the process for practicing the invention at a bench scale, 1–100 amperes, proceeds as follows.

At the start of the run, a well-mixed salt bath of the chosen composition of an alkali metal fluoride and at least one additional metal fluoride, preferably a eutectic mixture of the two fluorides, is added to the cell with all of the electrodes in place. The salt is heated to form the molten bath and contains a metal oxide of the metal to be recovered in solution with the molten salt bath, preferably in saturated solution with the molten salt bath. In one embodiment of the invention, alumina chips are added to the melt as the source of alumina. Gas, such as argon, air, or the gas evolved from the anode, may be bubbled through the chips to assist in achieving $Al_2O_3$ saturation. This method of self-feeding has been found to be very effective in maintaining $Al_2O_3$ saturation. A current is passed between the inert anode and the cathode and through the melt. The current maintains the melt at the preferred temperature, preferably less than 900° C. and most preferably at 700°–800° C. A current density preferably in the range 0.1–1.50 A/cm$^2$ is maintained at the anode and molten metal is recovered.

The metal oxide may be selected from the group aluminum oxide and magnesium oxide, in order to produce aluminum and magnesium, respectively. Other metal oxides could be used, as will now be appreciated by those skilled in the art.

As the electrolysis proceeds, there may be some loss of fluoride salts and some evolution of HF gas. It is desirable, when fluoride salt losses become significant, to add makeup fluoride salt to the bath to maintain substantially the same bath ratio throughout the run as existed at the beginning of the run and in order to maintain bath depth. However, even when it is necessary to add makeup fluoride salt, we have found the amount of fluoride salt needed to be added when practicing the present invention to be roughly a third or less than the amount of salt that must be added during the Hall cell process, given the same rate of gas evolution from the cell.

Because inert anodes are used in the process of this invention, oxygen, rather than CO or $CO_2$ is produced at the anode and may be collected.

EXAMPLES

A schematic of a cell used in connection with a highly preferred bench scale embodiment of the present invention is illustrated in FIG. 4. A 99.8% pure alumina crucible 200 was used to contain the salts and electrodes. Alumina chips 201 (approximately 200 gms, −3 to +6 mesh, 99.5% pure tabular alumina) were packed in the bottom of the large crucible 200, around a second, smaller alumina crucible 202 which was used to contain the cathode 203, and 40 grams of high purity aluminum (99.999% pure). A tungsten or graphite rod 204, sheathed in alumina 205, was used to collect current from the cathode. Tungsten rods were preferable because they had less potential for carrying impurities into the cells. An argon bubbler 206 (through an alumina tube) was embedded in the alumina chips 201 to keep the salt saturated with alumina Using this approach alumina was self-fed to maintain saturation. Gases other than argon, such as nitrogen may be used. In addition, with the proper design, gas evolved from the anode can be used Although inert gasses are preferred, air may be used for the bubbling in view of the use of the inert anodes of the invention. An alumina sheathed thermocouple 207 was placed in the salt bath and used to control the temperature of the cell. The anode 208, having an active surface area about equal to the projected surface area of the anode, was typically immersed to a depth of 6 mm as shown in FIG. 4. In addition, a reference electrode 209 (Ag/AgCl) and/or an alumina or salt feed port (not shown) may be used. Regardless of the specifics of the cell setup, generally only the inert anode 210, argon purge gas, supplied through the bubbler 206, alumina 201, when used, graphite, and high purity aluminum 203 were in contact with the salt bath 211.

During testing the salt-containing alumina crucible 200 was housed in a stainless steel container 212. The annulus between the alumina crucible 200 and the stainless steel container 212 was packed with graphite felt 213 and the ensemble was placed in a furnace.

The current densities used in different tests ranged from 0.12 to 1.12 A/cm$^2$. Typically 0.23 and 1.00 A/cm$^2$ current densities were used. In addition, higher and lower values were used in an effort to determine the robustness of the cermet performance with respect to current density.

The preferred cermet anode composition of the present invention contains primarily three different phases.

There are preferably two oxide phases, a spinel phase having the composition $Ni_xFe_{3-x}O_4$ and an NiO-rich $Ni_xFe_{1-x}O$ phase. The third phase, the metallic phase, preferably is Cu rich and contains small amounts of Ni and a smaller amount of Fe and is denoted by a Cu (Ni, Fe) alloy phase. The primary function of the oxide phase is to impart the corrosion resistance, oxidation resistance and chemical durability and the functions of the metallic phase are to improve the electrical conductivity, provide the mechanical strength and fracture toughness and improve thermal shock properties.

An inert anode used in the examples depicted herein was prepared by isostatic pressing and sintering. This anode is illustrated in FIG. 5. The flow characteristics of the spray dried agglomerated powders used enable anode fabrication into green shapes, without pressing flaws or laminations. As illustrated, the anode of FIG. 5 was welded to an INCONEL or nickel rod. The anode had a cermet portion 100, a transition portion 101, which gradually blended into an all metal portion 102. U.S. Pat. No. 4,500,406 (Weyand et al.), incorporated by reference herein, discloses methods and techniques for forming inert anodes and connections therefore, which methods and techniques may be used in forming the transition portion, 101 and the all metal portion 102. Spray dried powder (5324) comprising 51.7 weight percent NiO and 48.3 weight percent $Fe_2O_3$ and copper powder (−325 mesh) was used to prepare the cermet portion 100 of the anode which exhibited a bulk density of about 6 grams per $cm^3$ and an apparent porosity of about 0.5%. Virtually all of the copper powder was in the range of 10–100 microns. In general, improved electrical conductivity is achieved by lowering the copper particle size. The grading of the transition portion 101 of the anode was achieved by varying amounts of copper and nickel powder which were added to the oxide composition, varying the grading until the uppermost all-metal portion 102 of the anode comprised only copper or nickel. However, sintering would have to be limited to a lower temperature to incorporate all copper and, therefore, nickel was preferred for the all-metal portion 102. These samples were suitable for brazed, welded or mechanical connections.

Isostatically pressed anodes, with graded composition near the top, were produced by filling an isostatic bag with approximately 70 gms of 83% 5324 and 17% copper powder. In both the uniaxially and isostatically pressed samples, four layers of graded composition comprising 25, 50, 75 and 100% nickel and the balance cermet were used in forming the transition portion 101. The topmost layer 102 contained 100% nickel. The thicker the topmost layer 102, the more suitable the layer is for welded or brazed connections.

The isostatically pressed anodes were pressed at 20,000 psi and sintered at 1350° C.

The preferred salt baths used in connection with the present invention include at least one alkali metal fluoride other than LiF (e.g. NaF) and at least one additional metal fluoride such as aluminum fluoride, calcium fluoride, magnesium fluoride or another metal fluoride. The low temperature salt baths are operated at temperatures preferably less than 900° C. and most preferably from a range of about 685° C.–850° C. in the case of aluminum production. In a preferred embodiment of the invention, the salt bath comprises NaF and $AlF_3$, and preferably comprises 30–60 mole percent NaF, and more preferably comprises an NaF:$AlF_3$ mole ratio of about 1:2 to about 1:3. In a highly preferred embodiment of the invention, the salt bath comprises a mixture of NaF and $AlF_3$ in a weight ratio of about 0.5–1.2 NaF:$AlF_3$. In a most preferred embodiment of the invention, the salt bath comprises about 36% by weight NaF and about 64% by weight $AlF_3$. In a most preferred embodiment of the invention, this salt bath is used without any other additives and operated at this 36/64 weight ratio, which ratio corresponds to the eutectic composition of the NaF/$AlF_3$ melt. The eutectic mixture has a melting point of about 695° C. as illustrated in FIG. 7.

Other salt baths which may be used according to the present invention include those illustrated in FIG. 8. FIG. 8 illustrates a phase diagram for an NaF-$MgF_2$ salt bath, showing the eutectic points at about 25 and 60 mole % NaF and 830° C. and 1000° C., respectively.

Table 1 below depicts salt combinations which have been tested according to the present invention. It will now be appreciated by those skilled in the art that other combinations of low temperature salt baths would be useful in practicing the invention.

TABLE 1

$AlF_3$ 64 w %, NaF 36 w %
NaF 70.5 w %, $MgF_2$ 29.5 w %

Most surprisingly, we have unexpectedly found that of all the low temperature salt baths used in accordance with the present invention, the NaF/$AlF_3$ eutectic composition exhibited the best results, resulting in good metal production and minimal anode corrosion, despite having a low electrical conductivity relative to other salt bath compositions. In general, the lithium-containing salts performed poorly, resulting in significant anode corrosion.

Three anodes containing 17 weight percent copper and 83 weight percent of the metal oxide (51.7% by weight NiO and 48.3% by weight $Fe_2O_3$) were tested in a low temperature electrolyte containing 64 weight percent $AlF_3$ and 36 weight percent NaF at 750° C. The anodes were tested at 0.23 A/$cm^2$ and at 1 A/$cm^2$ for a period of 30–60 hours. The anodes were sectioned after the test and visual examination showed no apparent degradation of the anodes. Most surprising was the fact that these anodes, which were not imparted with increased surface area such as is taught by the prior art as being necessary for low temperature salt baths, were able to run effectively at a high current density of 1 A/$cm^2$ for the duration of the test. In this example, alumina was provided to the salt bath and alumina chips were maintained in the bottom of the crucible throughout the run. No additives were used in connection with the salt bath of this example and the anodes showed extremely high corrosion resistance, as microscopic inspection revealed that the anode tested at 0.23 A/$cm^2$ for 30 hours and 62 hours showed an affected zone of less than 10 microns to 150 microns. The anode tested at 1 A/$cm^2$ did not show any reacted area, although some cracks were visible near the bottom of the anode. The sides of this anode appeared to be in extremely good shape with no noticeable corrosion.

Figure 3B:
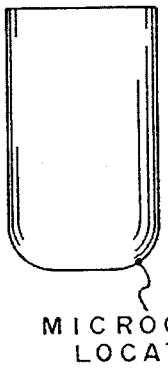
FIG. 3*b* is a schematic representation of an anode illustrating the approximate location of the micrograph of FIG. 3*a*.

FIG. 3*a* is an SEM micrograph at 40× magnification of a section of an inert anode of the invention after $Al_2O_3$ electrolysis for six hours in a molten salt bath comprising 41.9 wt. % NaF, 43.6 wt %, $AlF_3$ and 14.5 wt. % LiF. FIG. 3*b* schematically illustrates the location of the inert anode from which the section shown in FIG. 3*a* was taken. As is readily apparent, the anode of FIG. 3*a* experienced significant corrosion, as evidenced in the micrograph by the pervasive porosity present.

Figure 3C:
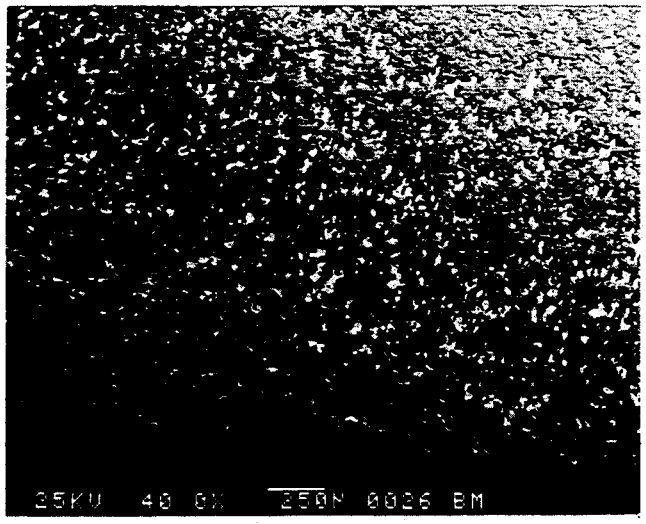
FIGS. 3*c*–3*h* are SEM micrographs and x-ray images of the same type of inert anode used in FIG. 3*a*, after electrolysis in a 36 wt. % NaF/64 wt. % $AlF_3$ electrolyte.
Figure 3D:
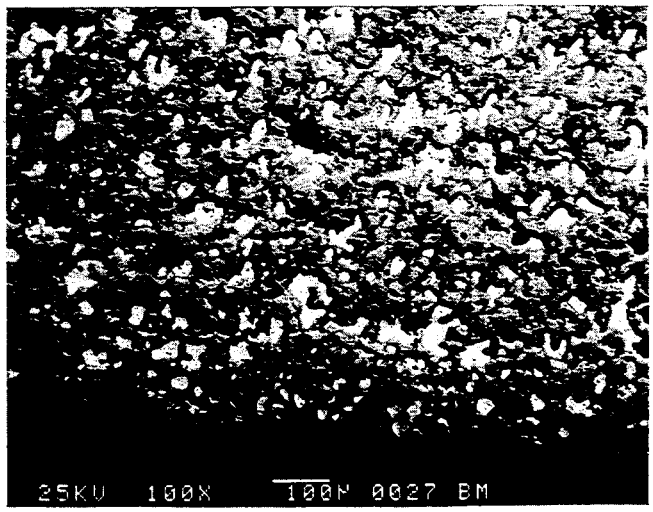
Figure 3E:
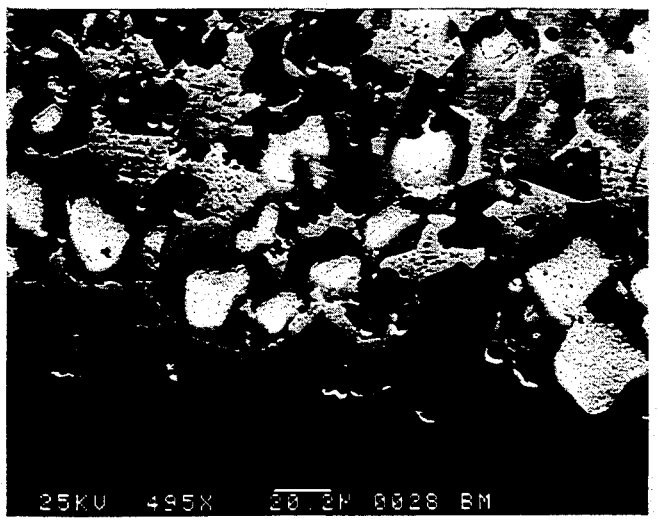
Figure 3F:
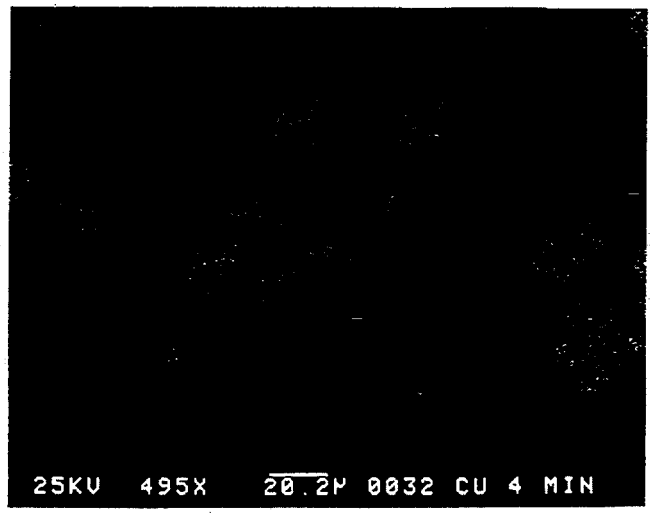
Figure 3G:
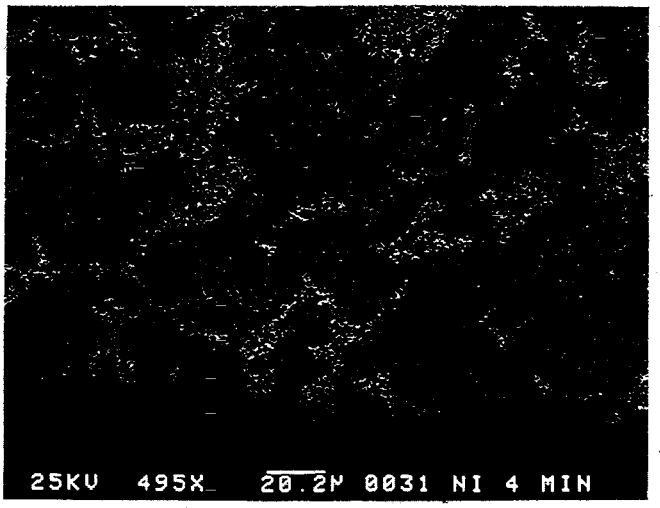
Figure 3H:
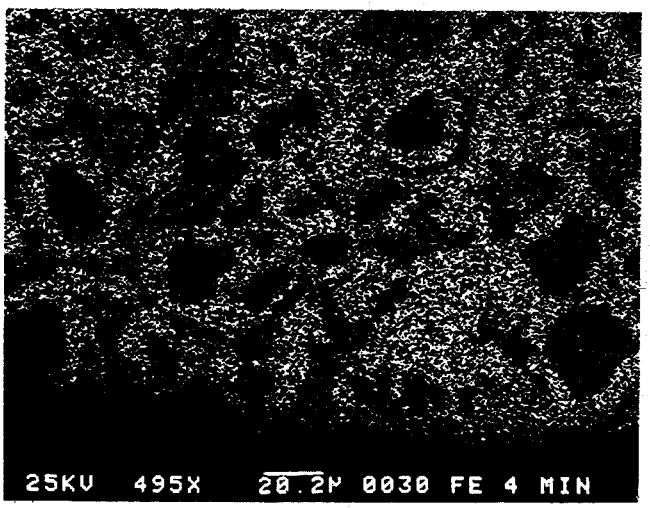

FIGS. 3*c*–3*e* are SEM micrographs of a section of an inert anode of the invention, taken at 40×, 100× and 495× magnification, respectively. FIGS. 3*f*–3*h* are X-ray images corresponding to Cu Ni and Fe respectively, of the same anode of FIGS. 3*c*–3*e*, all at 495× magnification. The anode of FIGS. 3*c*–3*h* was used for the electrolysis of $Al_2O_3$ for 44.3 hours, according to the conditions reported in Table 2 for Run #40.

As best illustrated by FIGS. 3*c*–3*e*, the inert anode of the invention demonstrated relatively little, if any, corrosion or metal loss, as contrasted with that of FIG. 3*a*. Indeed, although some porosity increase was found within 500 microns of the surface, this did not appear to be associated with any particular phase and is not believed to have been caused by corrosion and no metal phase loss was found in the anode of Run #40.

Figure 3I:
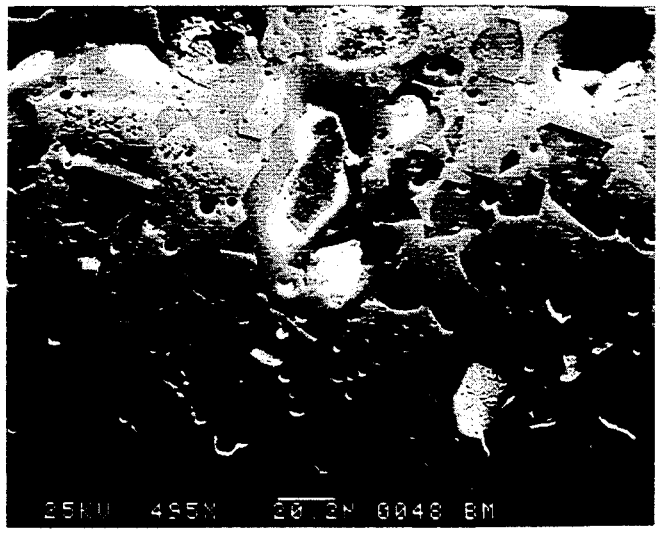
Figure 3J:
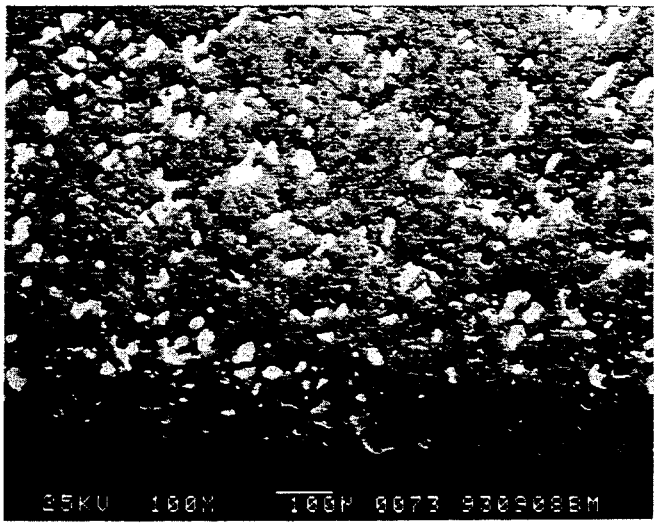
Figure 3K:
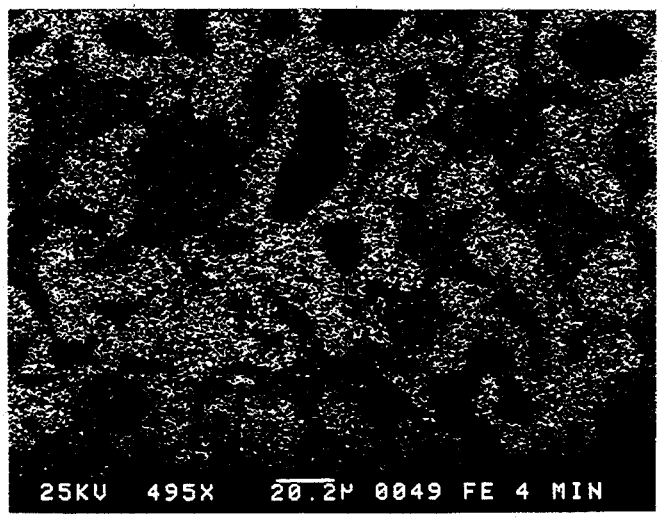
Figure 3L:
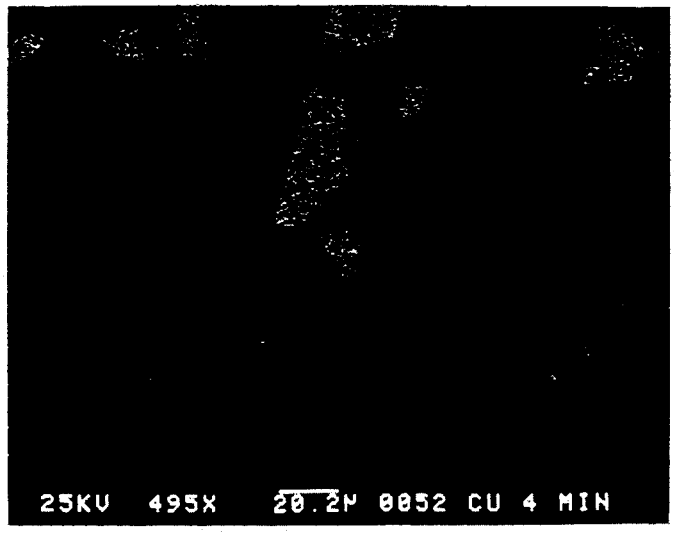
Figure 3M:
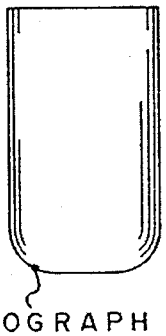
FIG. 3*m* is a schematic representation of an anode illustrating the approximate location of the micrograph of FIGS. 3*c*–3*l*.

FIGS. 3*i*–3*l* are SEM micrographs and X-Ray images of a section of an unexposed anode, taken at approximately the same location (illustrated in FIG. 3*m*) as that of FIGS. 3*c*–3*h*. FIGS. 3*i* and 3*j* are SEM micrographs of the unreacted inert anode at 496× and 100× magnification, respectively. As these Figures demonstrate, the levels of porosity of the exposed anodes of FIGS. 3*d* and 3*e* compare favorably with unexposed anodes, FIGS. 3*j* and 3*i*, respectively, when viewed under similar magnification. This comparison demonstrates that the porosity of the Run #40 anode was not caused by corrosion from the salt bath.

Table 2 summarizes several runs according to the method of the invention at 0.23 and 1.00 A/cm$^2$. Run 17 was unacceptable, and the reasons for its failure are suspected to be tied to aluminum contacting the anode during the 24 hour test, whereas in the other runs illustrated, this did not occur. This table demonstrates that the method of the invention may be practiced at low temperatures, using the salt bath compositions and inert anodes disclosed herein, which anodes experience relatively little corrosion, as evidenced by the affected zone depth of the anode.

TABLE 2

| Run # | A/cm2 | Temp °C. | Electrolyte Components | Component Weight % | Amp-Hrs | Avg. Amps | Affected Zone depth (microns |
|---|---|---|---|---|---|---|---|
| | | | Depth of Affected Zone | | | | |
| 11 | 0.23 | 840 | NaF, AlF3 | 36, 64 | 1.72 | 0.27 | <10 |
| 14 | 0.23 | 780 | NaF, AlF3 | 36, 64 | 1.72 | 0.27 | <20 |
| 17 | 0.23 | 780 | NaF, AlF3 | 36, 64 | 7.00 | 0.27 | 200 |
| 37 | 0.22 | 765 | NaF, AlF3 | 36, 64 | 7.6 | 0.27 | 25 |
| 39 | 1.00 | 765 | NaF, AlF3 | 36, 64 | 40.9 | 1.18 | <10 |
| 40 | 1.00 | 765 | NaF, AlF3 | 36, 64 | 52.3 | 1.18 | <10 |

All current densities referred to herein are calculated on the basis of the actual, immersed surface area of the anode. As used herein, the term "high current densities" includes those densities greater than about 0.5 A/cm$^2$. As used herein, the term "low surface area anodes" refer to those anodes which function only as planar electrodes, rather than three dimensional electrodes. As used herein, the terms "actual," "active" and "wetted" surface area, when used with reference to electrodes, are used interchangeably.

It has been found that the inert anodes of the present invention function best as planar, or low surface area anodes when used in the preferred low temperature salt bath comprising the eutectic $NaF/AlF_3$ mixture. Also as used herein, the term "low temperature" salt bath refers to those salt baths operated at temperatures below the conventional Hall cell operating temperatures, or less than about 900° C.

The process of the present invention has been found to result in significant reduction in salt loss and a unit which is relatively simple to control in terms of the bath chemistry. The use of the inert anode produces a second potentially useful product in the form of oxygen and the low temperature salt bath permits the use of refractories and improved heat loss control. The system potentially may be operated as a closed system requiring no carbon anode changes and, due to the unexpected ability of the system to operate at commercial current densities, the present invention may be practiced by retrofitting existing smelters.

The invention may be practiced in connection with the production of metals other than aluminum. Electrolysis of MgO for the production of magnesium may be achieved, for example, by using the salt baths and inert anode of the invention and using a pool of aluminum or magnesium as the cathode. Since magnesium has a melting point (650° C.), very close to that of aluminum, (660° C.), bath temperatures may be maintained at or near those used for aluminum to produce molten magnesium.

Metals having a melting point exceeding that of the salt bath may be electrolyzed using the salt bath and inert anodes of the invention. In this case, an aluminum pool used as the cathode forms an alloy with the metal being electrolyzed. This approach is frequently used, for example, to recover iron, titanium and silicon from their oxides, during aluminum can recycling operations. See e.g., PCT Application WO89/06291.

This invention and many of its attendant advantages will be understood from the foregoing description, and it will be apparent that various modifications and changes can be made in the process for electrowinning metal without departing from the spirit and scope of the invention or sacrificing all of its material advantages, the process hereinbefore described being merely a preferred embodiment. For example, the process of this invention can alternatively be carried out by electrolyzing metal oxides other than aluminum for the production of metals such as magnesium, silicon, and titanium, as well as lead, zirconium and zinc.

The present invention has been described above in terms of oxides of aluminum, which are representative of the invention. The particular examples described herein are merely illustrative of the invention, which is defined more generally by the following claims and their equivalents. While many objects and advantages of the invention have been set forth, it is understood that the invention is defined by the scope of the following claims, not by the objects and advantages. For example, though one advantage of the invention is its use in the electrowinning of aluminum, it will be immediately appreciated by those skilled in the art that the method of the invention may be practiced upon oxides of other metals, and the claims, where not otherwise limited, are intended to embrace this and all other uses of the invention.

We claim:

1. A method of varying power input to an electrolyte-containing, electrolytic cell having electrodes in the form of interleaved anodes and cathodes, comprising sensing cell temperature and varying the amount of electrolyte between the electrodes to control cell temperature sensed in the step of sensing.

2. A method as claimed in claim 1, comprising varying the amount of interleaving to vary the amount of electrolyte between the electrodes.

3. A method as claimed in claim 1, comprising varying the amount of immersion of the electrodes in the electrolyte to vary the amount of electrolyte between the electrodes.

4. A method as claimed in claim 1, comprising sensing heat loss from the cell and varying the amount of electrolyte between the electrodes to adjust for heat loss sensed in the step of sensing.

5. A method as claimed in claim 1, comprising calculating power as the product of current and voltage and varying the amount of electrolyte between the electrodes to control the power calculated in the step of calculating.

6. A method as claimed in claim 1, further comprising operating the cell in an essentially constant current mode.

7. The method of claim 1 wherein said anodes comprise cermet anodes and said electrolyte comprises aluminum oxide or magnesium oxide dissolved in a molten salt bath.

8. The method of claim 1 wherein said cell temperature is maintained at less than about 900° C.

9. A temperature control method for an electrolytic cell containing an electrolytic bath, comprising providing in the cell interleaved anodes and cathodes which are at least partially immersed in said bath and further comprising the steps of sensing cell electrolyte temperature and varying the extent of cross-sectional area available for current flow between the interleaved anodes and cathodes to vary $I^2R$ loss to control temperature sensed in the step of sensing.

10. The temperature control method of claim 9 wherein said interleaved anodes and cathodes are fixed relative to one another and the varying of the cross-sectional area for current flow between the interleaved anodes and cathodes is achieved by providing said interleaved anodes and cathodes in a fixed assembly and varying the amount of surface area of said anodes and cathodes wetted by said electrolytic bath.

11. The method of claim 10 wherein said cross-sectional area for current flow is varied by raising or lowering said fixed assembly relative to the level of said bath.

12. The temperature control method of claim 9 wherein said interleaved anodes are moveable with respect to said cathodes and the varying of the cross-sectional area for current flow between the interleaved anodes and cathodes is achieved by varying the extent of interleaving between the anodes and cathodes.

13. The temperature control method of claim 12 wherein varying the extent of interleaving is achieved by at least partially withdrawing from or immersing into said bath at least some of the anodes and/or cathodes.

14. The method of claim 9 wherein said anodes comprise cermet anodes and said electrolyte comprises alumina dissolved in a molten salt bath.

15. The method of claim 9 wherein said electrolyte comprises alumina dissolved in a molten salt bath comprising $AlF_3$ and NaF.

16. The method of claim 9 wherein said anode means comprise about 12–25% by weight copper and about 75–88% by weight oxides comprising about 50–60 mole % NiO and about 40–50 mole % $Fe_2O_3$, and said molten salt bath comprises alumina, $AlF_3$ and NaF.

17. An apparatus for electrowinning metal comprising a crucible containing a molten salt bath;

a vertical array of interleaved anode and cathode means, at least a portion of which are positioned within said molten salt bath:

means providing current between said anode and cathode means; and means controlling temperature of said molten salt bath and said anode and cathode means, comprising salt bath temperature sensing means supplying a temperature-indicative signal to a computer means, said computer means controlling an electrode positioning means in response to said signal, which positioning means varies the degree of wetting of said anode and/or cathode means by said molten salt bath, thereby varying $I^2R$ loss and controlling the temperature in said molten salt bath.

18. The apparatus of claim 17 wherein said crucible is insulated.

19. The apparatus of claim 17 wherein said anode means comprise inert anodes.

20. The apparatus of claim 17 wherein said molten salt bath is a low temperature salt bath.

* * * * *

UNITED STATES PATENT AND TRADEMARK OFFICE

CERTIFICATE OF CORRECTION

PATENT NO. : 5,415,742

DATED : May 16, 1995

INVENTOR(S) : Alfred F. La Camera et al.

It is certified that error appears in the above-identified patent and that said Letters Patent is hereby corrected as shown below:

Col. 1, before line 5

Insert the following paragraph:

"GOVERNMENT CONTRACT

This invention was made with Government support under Contract No. DE-FC07-891D12848 awarded by the Department of Energy. The Government has certain rights in this invention."

Signed and Sealed this

Twenty-seventh Day of June, 2000

*Attest:*

Q. TODD DICKINSON

*Attesting Officer*

*Director of Patents and Trademarks*